US010391760B2

(12) United States Patent
Westhof et al.

(10) Patent No.: US 10,391,760 B2
(45) Date of Patent: Aug. 27, 2019

(54) METHOD FOR THE CONTROL OF THE ROTATIONAL SPEED FOR A DRIVE DEVICE OF A PRINTING ROLL

(71) Applicant: WINDMÖLLER & HÖLSCHER KG, Lengerich (DE)

(72) Inventors: Frank Westhof, Recke (DE); Wolfgang Knapheide, Lienen (DE); Mario Frankenberg, Osnabruck (DE); Uwe Howelmeyer, Ibbenburen (DE); Wolfgang Sprehe, Steinfeld (DE); Frank Gunschera, Osnabruck (DE)

(73) Assignee: WINDMOLLER & HOLSCHER KG, Lengerich (DE)

( * ) Notice: Subject to any disclaimer, the term of this patent is extended or adjusted under 35 U.S.C. 154(b) by 0 days.

(21) Appl. No.: 14/917,774

(22) PCT Filed: Jun. 30, 2014

(86) PCT No.: PCT/EP2014/063861
§ 371 (c)(1),
(2) Date: Jun. 22, 2016

(87) PCT Pub. No.: WO2015/032518
PCT Pub. Date: Mar. 12, 2015

(65) Prior Publication Data

US 2016/0288489 A1 Oct. 6, 2016

(30) Foreign Application Priority Data

Sep. 9, 2013 (DE) ..... 10 2013 109 851

(51) Int. Cl.
*B41F 33/00* (2006.01)
*B41F 31/00* (2006.01)
(Continued)

(52) U.S. Cl.
CPC ..... *B41F 33/00* (2013.01); *B41F 5/24* (2013.01); *B41F 13/0045* (2013.01); *B41F 31/004* (2013.01)

(58) Field of Classification Search
CPC .... B41F 31/004; B41F 13/0045; B41F 33/00; B41F 5/24
See application file for complete search history.

(56) References Cited

U.S. PATENT DOCUMENTS 5,542,353 A 8/1996 Cuir et al.
6,298,779 B1 * 10/2001 Gotanda ..... B41F 31/004 101/148
(Continued)

FOREIGN PATENT DOCUMENTS

DE 19519141 A1 12/1996
EP 1604820 A1 12/2005

OTHER PUBLICATIONS

International Search Report and International Preliminary Report on Patentability issued in PCT/EP2014/063861, which the present application is a National Phase of.
(Continued)

*Primary Examiner* — David H Banh
(74) *Attorney, Agent, or Firm* — Porzio Bromberg & Newman P.C.

(57) ABSTRACT

The invention relates to a method for the control of the rotational speed for a drive device (20) of a printing roll (10) with a resilient printing sleeve (12) of a flexo printing press (100) comprising the following steps:

Figure 1:
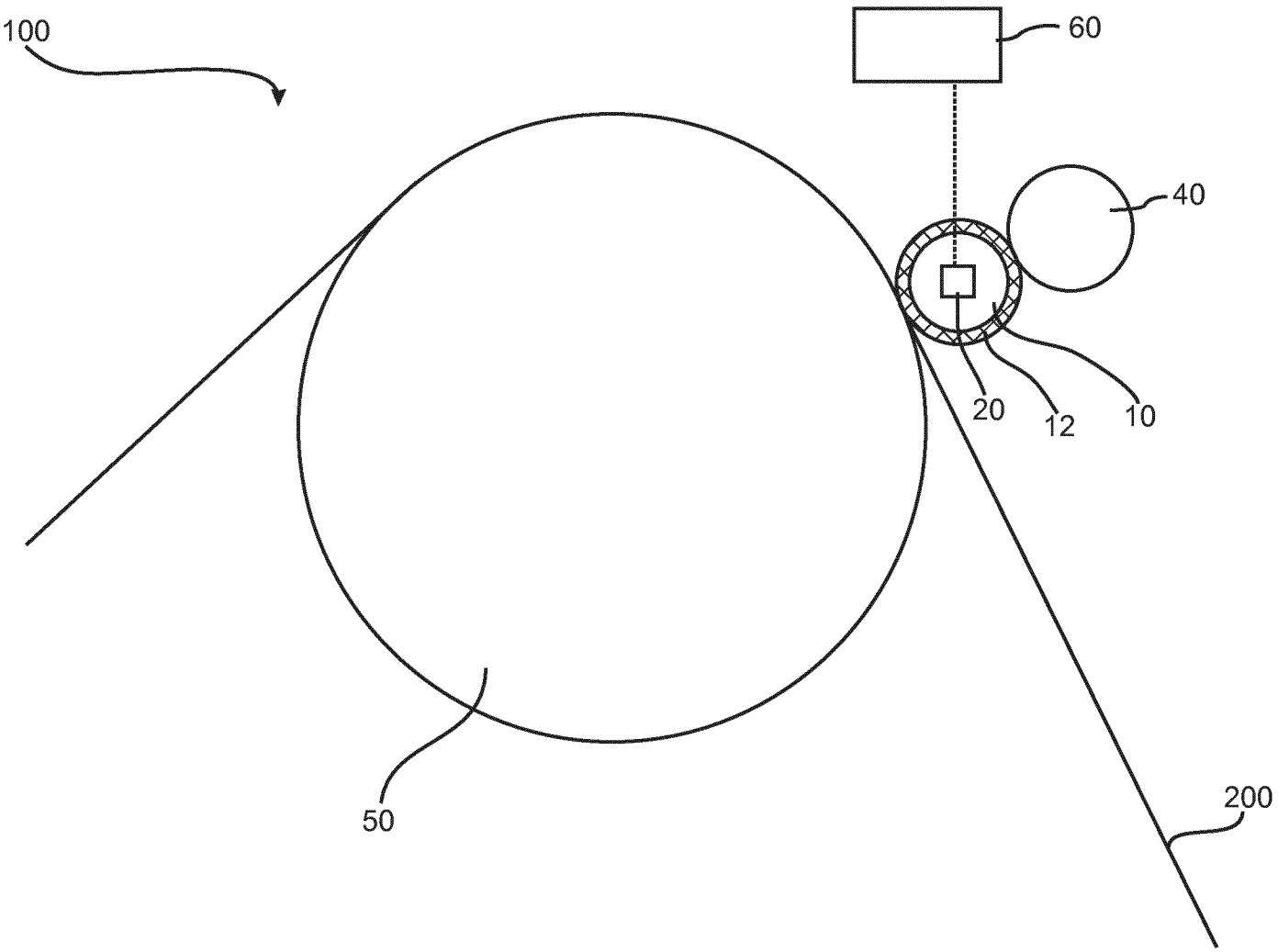

Determination of a first rotational speed (V1) of the printing roll (10) in the free wheeling without active drive device (20) with a first adjusting value (B1), Determination of a second rotational speed (V2) of the printing roll (10) in the free wheeling without active drive device (20) with a second adjusting value (B2),
(Continued)

Generation of a control curve (30) of the rotational speed related to the adjusting value on the basis of the determination steps, Usage of the control curve (30) for the control of the rotational speed of the printing roll (10) with an active drive device (20).

11 Claims, 3 Drawing Sheets

(51) Int. Cl.
*B41F 5/24* (2006.01)
*B41F 13/004* (2006.01)

(56) References Cited

U.S. PATENT DOCUMENTS

2010/0288142 A1* 11/2010 Sugimoto ..... B41F 31/36
101/216
2013/0335496 A1* 12/2013 Leighton ..... B41J 2/0057
347/103
2014/0369727 A1* 12/2014 Tsunoda ..... G03G 15/2064
399/329

OTHER PUBLICATIONS

German Office Action dated Mar. 11, 2014 issued in German Patent Application No. 102013109851.7, which is the corresponding German application to the present U.S. application and which the U.S. application claims priority to.

German Office Action dated Jul. 13, 2015 issued in German Patent Application No. 102013109851.7, which is the corresponding German application to the present U.S. application and which the U.S. application claims priority to.

Kipphan, Helmut: Handbook of print media. Berlin Heidelberg New York: Springer Verlag, 2000. p. 47-48.—ISBN 3-540-66941-8.

German Office Action, dated Mar. 8, 2017.

Schaschk et al; The Effect of printing blankets on the rolling condition of printing cylinders; TAGA, 2001, 1-12.

* cited by examiner

METHOD FOR THE CONTROL OF THE ROTATIONAL SPEED FOR A DRIVE DEVICE OF A PRINTING ROLL

The present invention relates to a method for the control of the rotational speed for a drive device of a printing roll with a resilient printing sleeve of a flexo printing press and a flexo printing press with a control unit for performing such a method.

It is basically known that a printing roll with a resilient printing sleeve is used with these printing presses. Often this printing sleeve is named printing plate or cliché and is pushed to the printing roll. The resultant configuration is an essential feature for the printing functionality of this printing sleeve. This leads to the fact that during printing a deformation of the resilient printing sleeve occurs. In a case where the position adjustment of the printing roll is changed relative to other rolls, the printing situation on the resilient printing sleeve conversely also changes. In an altered printing situation a crimping situation alters accordingly.

Depending on the crimping situation it has turned out that different speeds are set up for the printing rolls. Particularly, the printing situation alters the speed of the respective printing roll by an alteration of the crimping situation of the resilient printing sleeve. An increase of the speed of the printing roll occurs particularly, by an increase of the pressure due to an increase of the crimping. An increased speed, however, leads to the fact that this increase of speed has to be slowed down. This occurs for example by a corresponding braking effect of the drive device. This continuous slowing down of the printing roll leads to an increased wear out of the drive device. In a case, of the speed not being slowed it can lead to an undesired slip between the printing roll and e.g. the printing medium or a further roll. This slip leads to a friction between of the components which can lead to an increased wear out of said components. This problem was already described for example in DE 10 2010 015 628 A1. The solution in this document provides that the current printing situation in the form of the indentation depth of the printing sleeve has to be determined. On the basis of this indentation depth a control for the elimination of this effect has to be performed. However, it is a crucial disadvantage that this determination of the indentation depth occurs with a high constructional effort. Particularly, complex sensor systems are necessary in order to determine these parameters.

Thus, it is the object of the present invention to at least partially solve the previously described disadvantages. Particularly, it is the object of the present invention to provide the control of the rotational speed for the drive device of the printing roll in a cost efficient and simple manner.

The previous object is solved by a method with the features of claim 1 and a flexo printing press with the features of claim 11. Further features and details of the invention result from the dependent claims, the description and the drawings. Thereby, features and details which are described in relation to the method according to the invention naturally also apply in relation to the flexo printing press according to the invention and vice versa so that according to the disclosure of the single aspects of the invention it can always be reciprocally related to.

A method according to the invention serves for the control of the rotational speed for a drive device of a printing roll with a resilient printing sleeve of a flexo printing press. Such a method according to the invention comprises the following steps:

determination of a first rotational speed of the printing roll in a neutral gear condition without an active drive device with a first adjusting value, determination of a second rotational speed of the printing roll in a neutral gear condition without an active drive device with a second adjusting value, generation of a control curve of the rotational speed related to the adjusting value on the basis of the determination steps, use of the control curve for the control of the rotational speed of the printing roll with an active drive device.

By a method according to the invention a sensory determination of the indentation depth in a direct manner can be prevented. Rather, as a "simulated neutral gear condition" the adjusted altered speed is determined on basis of the described crimping effect of the resilient printing sleeve. Therewith, the crimping can be indirectly determined and the effect of the crimping can be directly determined. This simulated neutral gear condition serves for determining the effect and therewith the occurring relative speed to the printing medium or to contacting presses. Subsequently, on the basis of this simulated neutral gear condition an adjustment can be performed in the form of a use of the determined or generated control curve Adjusting values within the sense of the present invention are to be understood as distances which are configured between the printing roll and an adjacent roll. This value can be the adjusting value between the printing roll and the anilox roll and/or the adjusting value between the printing roll and the counter printing roll. Particularly, it is thereby related to the adjusting value in order to alter the pressure force on the printing medium. If the adjusting value is altered, the pressure situation on the resilient printing sleeves is altered accordingly. Accordingly, the rotational speed is determined relating not only to one single value but to at least two adjusting values in a method accordingly to the invention. In this simulated neutral gear condition at least two values for the control curve can be predetermined, which can serve as a basis for the generation of the control curve by the determination. Thereby, this control curve can be generated by any mathematic or technical measurement method. In addition to an entirely linear connection of the two determined measurement points for the first and second adjusting value complicated algorithms can likewise generate curved and not linear curve progressions for the control curve.

Within the scope of the present invention the method can be used for a printing roll with a fitted resilient printing sleeve and for a printing roll with a resilient printing sleeve molded thereto. Naturally, the effect according to the invention can be achieved when the printing roll is configured mainly completely from a resilient material as a printing sleeve.

According to the invention a distinction must be performed between an active and a passive drive device. An active drive device has to be understood as the switched-on drive device wherein for the generation of the rotational speed a torque of the drive device is transferred to the printing roll. A non-active drive device or a passive drive device is a simulated neutral gear condition. If the drive device is for example an electric motor, a rotor of the drive device is further rotating by the printing roll and the corresponding drive of the printing medium or a contacting press. In the passive state the drive device is further in the rotational operation accordingly, such that the rotational speed which is adjusted in the simulated neutral gear condition can be determined by the same sensors like it is the case for the regulation of the drive device. Therewith, no additional sensor units are necessary for the method according to the invention in order to perform the determination of the first and second rotational speed according to the invention. In comparison to known methods the reduction of the construction effort and the prevention of additional sensors which have to be adjusted is a main advantage.

The use of the control curve can either be used as a target value curve for a regulation or for a target value curve for the control. In both cases the control curve can provide the basic values for subsequent control. Naturally, the control curve can be used for the adjustment of the rotational speed of a counter pressure roll, an anilox roll or other rolls of the flexo printing press.

If in the course of printing an alteration of the adjusting values is performed in order to for example achieve an alteration of the printing image it can be reverted to the generated control curve. An alteration of the adjusting values will lead to an alteration of the crimping situation of the printing sleeve. This alteration of the crimping situation is however considered when using the control curve during the control of the rotational speed of the printing roll. The altered crimping effect is accordingly at least partially compensated by an altered control on basis of the control curve for the rotational speed of the printing roll.

By a method according to the invention a compensation of the described crimping effect occurs at least partially. This leads to the fact that the slip between the contacting components or the contacting rolls can be reduced or prevented. Further, it is enabled to protect the drive device from unnecessarily high wear out. In comparison to known methods, a possibility of controlling the compensation of the described crimping effect can be provided in a cost efficient and fast and simple manner. Particularly, such a method is used with a register released printing. The determination of the relative speed or the rotational speed to the adjusting values occurs thereby for example in the units meter per second or rounds per minute. The determination of the single values or the generation of the control curve is thereby specific for the used printing roll and/or the used resilient printing sleeve. If another resilient printing sleeve is drawn up to the printing roll, the method according to the invention should advantageously be performed again in order to generate the specific control curve for this operational situation and this resilient printing sleeve.

A method according to the invention can be further improved in that the control curve is at least partially generated as a linear course between the determined values and the adjusting values. This is a particularly simple and cost efficient and fast generation of the control curve. The two determined values are simply connected to one another with a linear line in a diagram. A particularly simple mathematical algorithm allows a particularly cost efficient generation of a corresponding control unit. Such a control curve serves as a basis for a subsequent control in form of a control and/or of a regulation of a particularly simple control basis.

A further advantage can be achieved when the method according to the invention is used for a register-free print. A register-free print is a print which particularly comprises only one colour. Therewith, no registration tolerance meaning no clean overlap of the single colour sections has to be considered. The freedom of register leads to the fact that an alteration of the printing speed can be accepted by a control of the rotational speed of the printing roll according to the invention. It is an advantage regarding the register tolerance when the register tolerance is taken into account by the control of the rotational speed. This can for example occur by an intervention of the rotational speed of different inking systems or the coordination during the control of the rotational speed of the printing rolls of different inking systems.

It is a further advantage when with the method according to the invention at least one further rotational speed of the printing roll is determined in the neutral gear condition without an active drive device with the further adjusting value. In other words, at least at a third point of time and by using the third adjusting value a third rotational speed or even more rotational speeds are determined with multiple adjusting values. This results in a high accuracy for the generation of the control curve. Thus, it can be reverted to a broader data basis for the generation of the control curve. By this determination the course between the single data points can likewise be configured linear so that as a result the different inclined layers with the different inclinations are part of the control curve. Likewise, the curve can be generated from a plurality of discrete values in form of a step-like configuration. In all these cases the increase of the data points, meaning the amount of further rotational speeds with further adjusting values, effects a higher accuracy during the generation of the control curve.

Likewise, it is an advantage when with the method according to the invention the determination steps are performed continuously or mainly continuously with the continuous or mainly continuous alteration of the adjusting value. In other words, a mainly continuous curve is recorded as a control curve and is therewith generated. The printing roll is moved towards the corresponding contacting counter printing roll or the printing medium and therewith the adjusting value is altered. At the same time the adjusting rotational speed is continuously or mainly continuously determined in the simulated neutral gear condition. The written curvature is the generated control curve. This can be a first calibration procedure with which the printing roll is driven across the whole adjusting area of the adjusting value. This generates a mainly continuous curve which is generated on the basis of a complex calibration procedure but comprises a significantly increased accuracy accordingly. Such an increased accuracy involves a more accurate adjustment during the use for the control function.

Likewise, it is an advantage when using a method according to the invention that the control curve is used for the control of the rotational speed of an anilox roll. This additional use situation for the control curve involves a further improvement concerning the compensation of the described crimping effect. Thus, the anilox roll preferably turns with the same or mainly the same rotational speed as the printing roll. Naturally, also the control of other rotational speeds, like for example the rotational speed of the counter printing roll, on the basis of the control curve is enabled. Therewith one and the same generated control curve which is specific for the resilient printing sleeve can be used for the control of multiple different rotational speeds of different components.

A further advantage can be achieved when with the method according to the invention a constructive undersize of the diameter of the printing roll is considered during the control of the rotational speed of the printing roll. Thus, the user of a printing machine can already consider the crimping effect when ordering the printing roll. By a constructional undersize, meaning a reduction of the diameter of the printing roll, an alteration of the speed of the printing roll, meaning particularly an acceleration of the printing roll by the pressure effect, is compensated. Therewith, this constructive undersize can already be considered with a method which is based on the order of the clients or the user of the printer machine.

Likewise, it is an advantage when with the method according to the invention the generated control curve is saved in relation to the used resilient printing sleeve and/or in relation to the printing roll. The storage occurs for example in a database relative to the resilient printing sleeve. Thus, a library can be generated which provides specifically generated control curves to the different resilient printing sleeves. The described calibration, meaning the performance of a method according to the invention, has to be performed only with a completely new resilient printing sleeve. If an already used resilient printing sleeve is used, the generated control curve saved in the database can be recalled. This accelerates the use during a change between the different resilient printing sleeves during printing of the flexo printing press.

With the method according to the previous paragraph it is further an advantage when the generated control curve is compared to a saved control curve. Particularly, this comparison occurs with a control curve from a database. Thus, a standard deviation of differently generated control curves can be performed to a specific resilient printing sleeve. The standard deviation serves for the improvement of the subsequent use for the control of the rotational speed of the printing roll. Likewise, a monitoring concerning the alteration of the specifically generated control curve can be a hint to an alteration or a wear out of the resilient printing sleeve. Thus, an early warning functionality can be provided by a comparison with the saved generated control curve.

A method according to the invention can be further improved in that the control curve is used in comparison to the rotational speed of at least one further roll, particularly an anilox roll and/or a counter printing roll. As already described it is particularly related to the relative speed between the printing roll and an at least one further roll. By the use of the control curve for multiple rotating components particularly a slip between these rotating components can be effectively prevented.

Further, the present invention is directed to a flexo printing press comprising a printing roll with a resilient printing sleeve and a control unit for the control of the rotational speed of the printing roll. A flexo printing press according to the invention is characterized in that the control unit is configured for the configuration of a method according to the invention. Accordingly, a flexo printing press according to the invention comprises the same advantages as described in detail regarding the method according to the invention.

Figure 2:
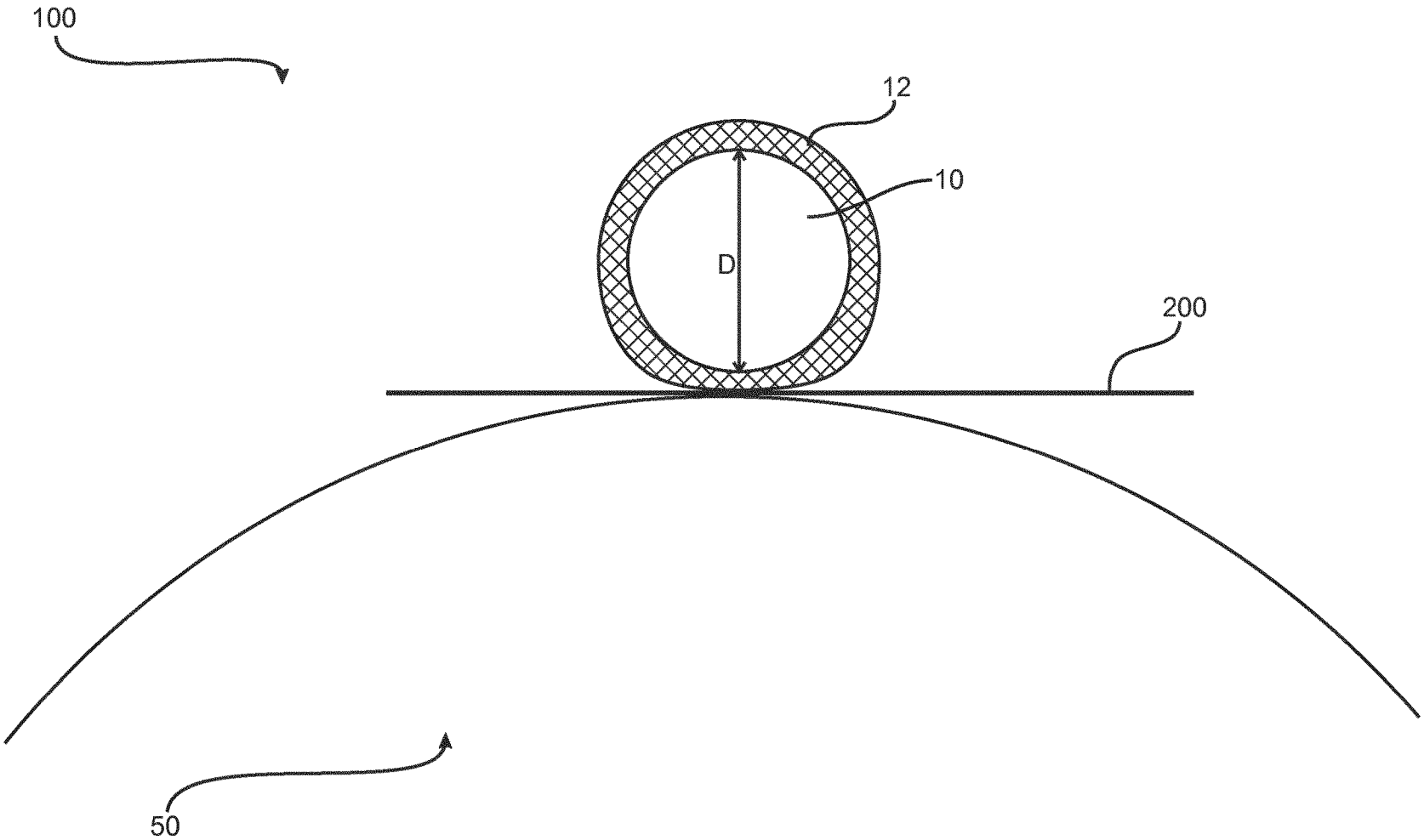
Figure 4:
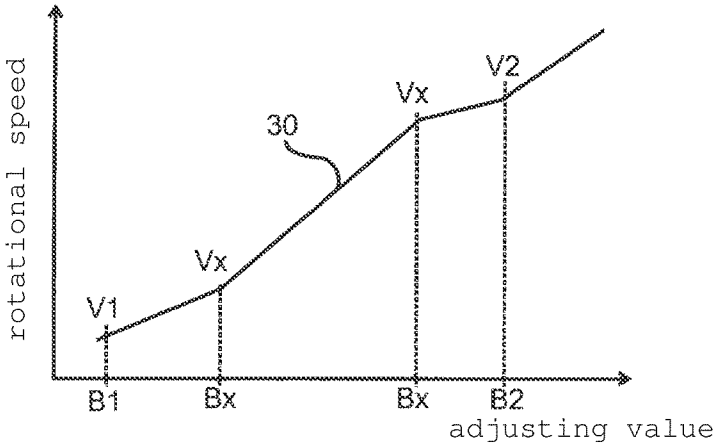
Figure 3:
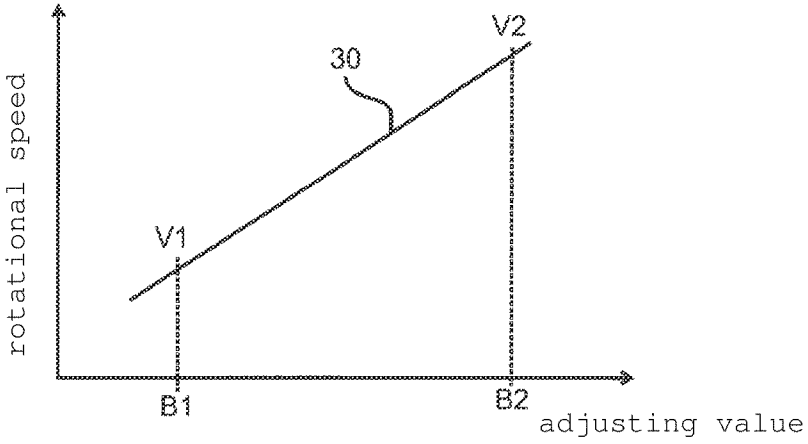
Figure 6:
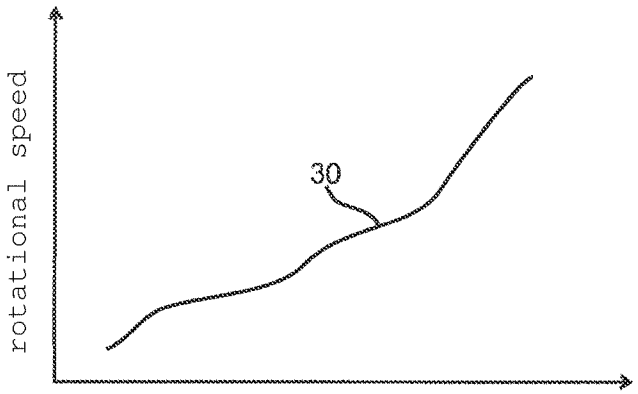
Figure 5:
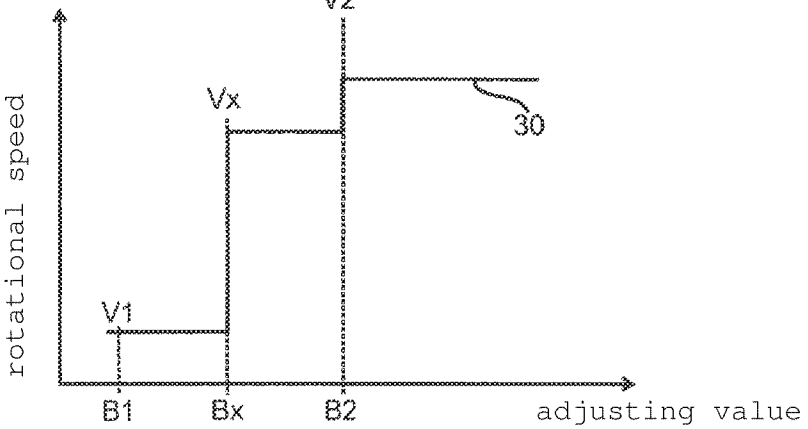

Further advantages, features and details of the invention result from the subsequent description in which embodiments of the invention are described in detail in relation to the drawings. Correspondingly, a flexo printing machine according to the invention has the same advantages as have been extensively explained regarding a method according to the invention. It is schematically shown:

FIG. 1 a first embodiment of a flexo printing press according to the invention, FIG. 2 the embodiment of FIG. 1 with the resilient printing sleeve in a crimped situation, FIG. 3 a first embodiment of a generated control curve, FIG. 4 a further embodiment of a generated control curve, FIG. 5 a further embodiment of a generated control curve and FIG. 6 a further embodiment of a generated control curve.

In FIG. 1 an embodiment of a flexo printing press 100 according to the invention is shown schematically. This flexo printing press 100 comprises a counter printing roll 50, an anilox roll 40 and a printing roll 10. On the printing roll 10 a resilient printing sleeve 12 is arranged which can for example be configured as a printing plate. Further, a drive device 10 for example in form of an electric motor is intended which serves for the drive of the printing roll 10.

Further, a control unit 60 is shown schematically which is coupled to the drive device 20 for the control of the rotational speed of the printing roll 10 via a data connection. Likewise, in FIG. 1 the curve of the printing medium 200 is shown.

In FIG. 1 the flexo printing press 100 with an inking system from an anilox roll 40 and a printing roll 10 is shown schematically. This embodiment is a register-free print with a single colour. Naturally, further inking systems can be provided wherein for each inking system an anilox roll 40 and a printing roll 10 can be intended.

In FIG. 2 the crimping situation is shown. Thereby, a crimping situation for the printing sleeve 12 is established between the printing roll 10 and the counter printing roll 50. During the conveyance of the printing medium 200 between both rolls 10 and 50 the supply in FIG. 2 occurs top down. The printing roll 10 is moved towards the counter printing roll 50 and the printing gap lying in-between is decreased. The printing medium 200 proceeds through this printing gap. After banding of the resilient printing sleeve 12 at the printing medium 200 subsequently a crimping of the resilient printing sleeve 12 occurs during an alteration of the adjusting value like it is schematically shown in FIG. 2. This crimping leads to a variation of the rotational speed of the printing roll 10. This variation leads to an increased wear out of the drive device 20 or to a slip at the printing medium 200 such that here a wear out at the printing medium 200 and at the resilient printing sleeve 12 can be determined. In order to prevent the crimping effect and the related problems the method according to the invention is performed like subsequently described.

In a first point of time, with a first adjusting value B1, in a simulated neutral gear condition, without active drive device 20, the first rotational speed V1 of the printing roll 10 is determined. Subsequently, in a second adjusting value B2 a second rotational speed V2 of the printing roll 10 is determined. Accordingly, these two determined values are registered in the diagram which applies the rotational speed via the adjusting value. Examples for such diagrams and control curves 30 generated therefrom are shown in FIGS. 3 to 6.

FIG. 3 is a particularly simple and cost efficient configuration of the generated control curve 30. Thus, here the at least demanded certain parameters for the first adjusting value B1 and the second adjusting value B2 are drawn in. In this embodiment the according rotational speeds V1 and V2 establish points in this diagram which are connected to one another along a line. Herein, a linear relation between the rotational speeds and the adjusting value is taken as a basis for the generation of the control curve 30. The corresponding generation of the control curve can be achieved accordingly with a simple and cost efficient generating algorithm. On the basis of this control curve 30 an adjustment or control of the rotational speed of the printing roll 10 occurs via an actively appearing drive device 20.

In FIG. 4 a further variation of the control curve 30 is shown. In this variation a respective further rotational speed Vx is determined to two further adjusting values Bx in addition to the first adjusting value B1 and to the second adjusting value B2, respectively. The courses between the single parameter values in the diameter according FIG. 4 are again on a linear basis. Thus, differently inclined lines between the single data values are established like shown in the control curve 30 according to FIG. 4. In comparison to FIG. 3 the effort for the determination of the values is increased, however a higher accuracy with the generation of the control curve 30 is achieved. Alternatively or in combination an embodiment according to FIG. 5 can be chosen. Thus by the adjusting value, a step function can be specified to the additional values or data values in the diagram of the rotational speed.

If the adjusting value is mainly continuously adapted or varied and the rotational speed at which it occurs is monitored continuously or mainly continuously, a completely free control curve 30 can be generated by recording this correlation. This is shown in FIG. 6. The calibration effort is thus the highest, however an ideal or optimized accuracy during the generation of the control curve 30 is achieved.

The previous description of the embodiments describes the present invention only within the scope of examples. Naturally, single features of the embodiments as far as technically meaningful can be freely combined with one another without leaving the scope of the present invention.

REFERENCE SIGNS

10 Printing roll
12 Resilient printing sleeve
20 Drive device
30 Control curve
40 Anilox roll
50 Counter printing roll
60 Control unit
100 Flexo printing press
200 Printing medium
B1 First adjusting value
B2 Second adjusting value
Bx Further adjusting value
D Diameter of the printing roll
V1 First rotational speed
V2 Second rotational speed
Vx Further rotational speed

The invention claimed is:

1. A method for the control of rotational speed for a drive device of a printing roll with a resilient printing sleeve of a flexo printing press comprising the following steps: adjusting a first adjusting value such that in a crimping situation the printing roll is moved towards a counter printing roll and a printing gap lying in between the printing roller and the counter printing roller is decreased after banding of the resilient printing sleeve at the printing medium;

subsequently crimping of the resilient printing sleeve occurs during an alteration of the first adjusting value to a second adjusting value, determination of a first rotational speed (V1) of the printing roll in a simulated neutral gear condition without an active drive device with the first adjusting value, determination of a second rotational speed (V2) of the printing roll in the simulated neutral gear condition without an active drive device with the second adjusting value, generation of a control curve of the rotational speed related to the first adjusting value and the second adjusting value on the basis of the determination steps, controlling of the rotational speed of the printing roll with an active drive device based on the control curve wherein the crimping leads to a variation of the rotational speed of the printing roll.

2. The method according to claim 1, wherein the control curve is generated at least sectionally as a linear course between the determined first adjusting value and the second adjusting value.

3. The method according to claim 1, wherein the method is used for a register-free print.

4. The method according to claim 1, further comprising the step of determination of a further rotational speed (Vx) of the printing roll in the simulated neutral gear condition without an active drive device with a further adjusting value (Bx).

5. The method according to claim 1, wherein the determination steps are performed continuously or substantially continuously in a continuous or substantially continuous alteration of the first adjusting value and the second adjusting value.

6. The method according to claim 1, further comprising the step of controlling a rotational speed of an anilox roll based on the control curve.

7. The method according to claim 1, wherein during the step of controlling of the rotational speed of the printing roll a constructive undersize of the diameter (D) of the printing roll is considered.

8. The method according to claim 1, wherein the control curve is saved in relation to the resilient printing sleeve and/or in relation to the printing roll.

9. The method according to claim 8, wherein the control curve is compared to the saved control curve.

10. The method according to claim 1, wherein the control curve is used to control the rotational speed of at least one further roll, the at least one further roll being an anilox roll and/or a counter printing roll.

11. A flexo printing press comprising a printing roll with a resilient printing sleeve and a control unit for the control of the rotational speed of the printing roll, wherein the control unit is configured performance using the method of claim 1.

* * * * *